United States Patent [19]

Brown et al.

[11] Patent Number: 4,697,981

[45] Date of Patent: Oct. 6, 1987

[54] ROTOR THRUST BALANCING

[75] Inventors: Wayne M. Brown, North Granby; William F. Neal, South Windsor; Frederick M. Schwarz, Glastonbury, all of Conn.

[73] Assignee: United Technologies Corporation, Hartford, Conn.

[21] Appl. No.: 681,332

[22] Filed: Dec. 13, 1984

[51] Int. Cl.[4] ..... F01D 3/00

[52] U.S. Cl. ..... 415/104

[58] Field of Search ..... 415/104, 105, 106, 107, 415/96, 98, 102; 416/95

[56] References Cited

U.S. PATENT DOCUMENTS

| | | | |
|---|---|---|---|
| 2,647,684 | 8/1953 | Lombard | 415/104 |
| 4,268,220 | 5/1981 | Malott | 415/104 |
| 4,306,834 | 12/1981 | Lee | 415/116 |
| 4,542,623 | 9/1985 | Hovan et al. | 415/170 R |

*Primary Examiner*—Robert E. Garrett
*Assistant Examiner*—John Kwon
*Attorney, Agent, or Firm*—Charles A. Warren

[57] ABSTRACT

A turbine construction in which the axial loading on the rotor including the compressor and turbine resulting from cooling air pressure in the compartment between the compressor and turbine is balanced by making the compressor and turbine areas exposed to the cooling air of equal area as by having the seals at compressor and turbine ends of the compartment equal in radius with respect to the air of the rotor.

3 Claims, 1 Drawing Figure

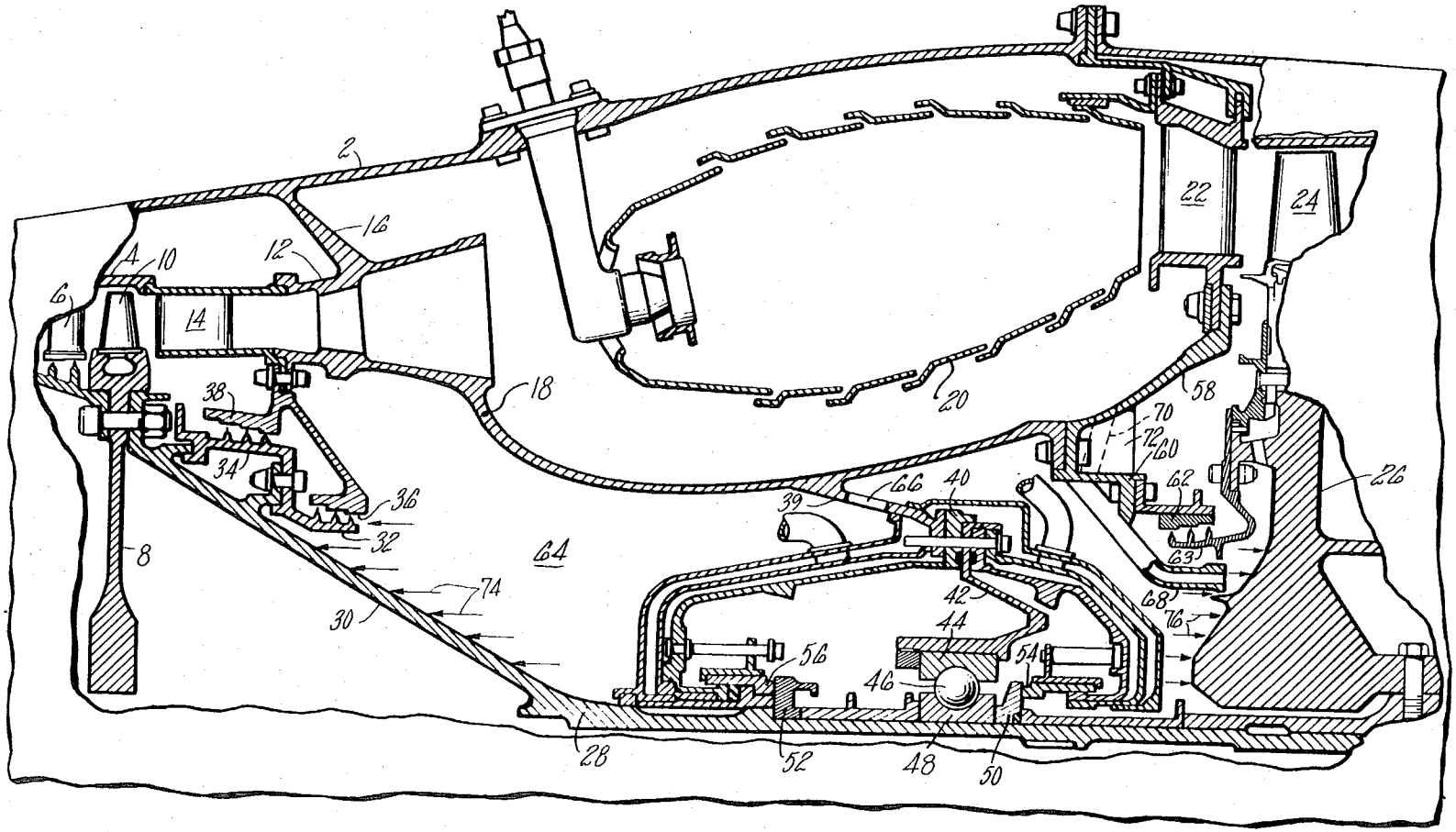
2
4
6
8
10
12
14
16
18
20
22
24
26
28
30
32
34
36
38
39
40
42
44
46
48
50
52
54
56
58
60
62
63
64
66
68
70
72
74

ROTOR THRUST BALANCING

TECHNICAL FIELD

This invention is concerned with the balancing of the thrust on turbine and compressor rotors to avoid thrust bearing load changes in spite of engine thrust class increases or decreases.

BACKGROUND OF THE INVENTION

Engines that are originally designed for a selected thrust can be operated at substantially higher or lower thrust levels successfully but such change frequently requires revision in engine opertion that must be compensated for. For example a higher turbine inlet pressure will require changes in the cooling air pressure requirements for the turbine rotor. Changes in the cooling air pressure may change the thrust load on the thrust bearing for the rotor or in a split engine the thrust load on a high pressure turbine rotor. The permissible load on the thrust bearing may be exceeded by a relatively small increase in the rotor cooling air pressure since this change in the air pressure may impact the entire front surface of the turbine disk and thus change the bearing load significantly. If the thrust bearing loading could be made independent of the thrust loads on the engine, any engine could be more readily adapted for substantially higher thrust levels without the need for significant revisions of the engine.

DISCLOSURE OF THE INVENTION

A feature of this invention is an arrangement by which the balance, the thrust loads on the last compressor rotor disk, or the rotor adjacent thereto and the first stage turbine disk independently of the engine thrust loads and thus allow higher turbine inlet pressures without overloading the thrust bearing.

Another feature is an arrangement by which to balance the pressure loads on the rotor independently of the cooling air requirments for the first turbine disk.

According to the invention, the seals for the air surrounding the rotor bearing and for controlling the cooling air acting on the face of the first turbine disk are located so that the same areas are exposed on both the last compressor disk or the equivalent structure at the last compressor disk and the first turbine disk. A suitable interconnection is made to maintain the same pressure acting on both the compressor portion and the turbine portion regardless of the cooling air requirement for the turbine or the pressure of the cooling air supplied from the compressor or from the space around the flame tube in the conbustion chamber. Although reference is made to the compressor disk the structure referred to is that portion of the rotor itself that is exposed to the air pressure from the cooling air and in the arrangement shown it is not necessarily the compressor disk but a portion of the rotor shaft that extends across the face of the compressor disk and is attached thereto adjacent the periphery of the disk.

Other features and advantages will be apparent from the specification and claims and from the accompanying drawings which illustrate an embodiment of the invention.

BRIEF DESCRIPTION OF DRAWINGS

The single Figure is a longitudinal sectional view through the combustion section of the engine showing the compressor and turbine rotors and the seal arrangements for them.

Best Mode for Carrying Out the Invention

The invention is shown in a twin spool engine of which only the high pressure spool is shown and, in fact, only a portion of the high pressure spool. The gas turbine engine has an outer case 2 that supports a compressor case 4 carrying several rows of compressor vanes, only the last row 6 of the vanes being shown. The last stage compressor disk 8 supports a row of blades 10 directly downstream of the vanes 6, and the blades 10 discharge compressed air into a diffuser 12 having straightening vanes 14 at its upstream end. This diffuser is supported within the case 2 by struts 16.

The diffuser discharges air under pressure from the compressor into a combustion chamber defined by the engine case as its outer wall and by an inner wall 18 extending downstream from the diffuser case. A flame tube 20 is located within the combustion chamber and discharges hot gas over the first stage turbine vanes 22 supported within the case 2.

Hot gas from the row of vanes 22 is discharged over the first stage turbine blades 24 carried by a rotor disk 26. This disk 26 is connected to a rotor shaft 28 that extends forward from the turbine disk and at its forward end is bolted to the compressor disk 8. The shaft has a conical portion 30 adjacent to the compressor disk and it is this conical portion that is exposed to the air pressure in balancing and the rotor. A pair of seal elements including an inner element 32 and an outer element 34 are bolted to the conical portion and cooperate with 6 inner and outer seal elements 36 and 38 supported from the diffuser case.

The inner wall 18 of the combustion chamber has a flange 39 that supports a housing 40 and a bearing support 42. The latter has an outer race 44 for bearing 46. The inner race 48 of the bearing is mounted on the shaft 28 as shown. This is shown as a thrust bearing to carry the thrust loads on the rotor. The shaft also carries the stationary rings 50 and 52 for oil seals 54 and 56 at opposite ends of the housing 40.

The downstream end of the inner wall 18 is secured by a ring 58 to the inner ends of the row of turbine vanes 22 and supports a bracket 60 for a fixed seal member 62. This seal member cooperates with a rotating seal member 63 mounted on the turbine disk 26. A pressure compartment 64 is defined in surrounding relation to the housing 40 by the conical portion 30 of the rotor shaft, the seal elements 32 and 36, the support for the seal 36, the diffuser, the inner wall 18 of the combustion chamber, the bracket 60, the seals 62 and 63 and the disk 26. The pressure in this compartment is balanced by a series of large holes 66 in the flange 39 that extends across this compartment. With the presence of these holes the pressure acting on the conical part of the shaft at the compressor end is the same as the pressure acting on the turbine disk 26. This pressure is maintained by a series of tubes 68 extending from the bracket 60 and connected to the combustion chamber externally the flame 2 by passages 70 in flanges 72 on the ring 58. The ends of the tubes direct cooling air from the combustion chamber onto the turbine disk for cooling it. The discharge ends of the tubes are directed tangentially towards the face of the disk to minimize the formation of vortices and drag on the disk surface but this is not a part of the invention and is not shown. The essential feature is that air at combustion chamber pressure reaches the compartment 64 and maintains the pressure therein and that this pressure is uniform throughout the compartment by reason of the series of holes 66.

The bearing 46 is shown schematically as a thrust bearing that carries the axial loads on the rotor. If the pressure is equalized on the face of the compressor and turbine portions of the rotor, the loads on the thrust bearings will be minimized and kept within reasonable limits in spite of varying pressures such as combustor chamber pressure, turbine inlet pressure, or cooling air pressure. This is accomplished by making the inner seal 32 on the compressor the same diameter as the seal 63 at the turbine thus leaving the same area at compressor and turbine ends of the compartment 64 to be acted upon by the pressure within the compartment. The arrows 74 at the compressor end and the arrows 76 at the turbine end delineate the areas acted upon by the pressure in the compartments 64. The area of the turbine disk radially outward of the outermost arrow 76 is balanced by an equal and opposing area of the seal structure 63. Since these seals form a part of the boundry for the compartment 64 and are located at the same radius and limit the exposure of the turbine disk at one end and the compressor portion ofthe shaft at the compressor end they assure that the pressure will be balanced on the rotor whatever the pressure becomes in the compartment 64.

It should be understood that the invention is not limited to the particular embodiments shown and described herein, but that various changes and modifications may be made without departing from the spirit and scope of this novel concept as definded by the following claims.

We claim:

1. A gas turbine construction in which the air thrust pressures on the rotor are balanced including:

a compressor disk having a row of blades thereon, a turbine disk having a row of blades thereon, a shaft connecting said disks and having a conical portion adjacent to the compressor disk and forming, with said disks, the rotor, a first seal carried by said conical portion, a fixed seal cooperating with said first seal, a second seal carried by the turbine disk, a fixed second seal cooperating with said second seal, a bearing for the shaft between the disks, a housing surrounding said bearing, a structure surrounding said housing and defining a compartment extending between the compressor and turbine disks and having as a part of the boundry thereof the conical portion of the shaft radially inward of the first seal and, as another part, the portion of the turbine disk radially inward of the second seal, and means for pressurizing the compartment wherein an inner wall of combustion chamber, a support extending from said inner wall to the housing to maintain it in relation to the inner wall and holes in said support to balance the pressure on opposite sides thereof, wherein the first and second seal are at substantially the same radius with respect to the rotor thereby to expose substantially the same area to the pressure in said compartment.

2. A gas turbine construction as in claim 1 in which the fixed seals are supported from the structure surrounding said housing.

3. A gas turbine construction as in claim 1 in which the first and second seals are so located that an equal area is exposed to the compartment for maintaining equal pressure loads on the conical portion and on the turbine rotor disk and in which the fixed seals are supported from said structure.

* * * * *